US006922917B2

(12) United States Patent
Kerns et al.

(10) Patent No.: US 6,922,917 B2
(45) Date of Patent: Aug. 2, 2005

(54) SHOE TIGHTENING SYSTEM

(75) Inventors: Mark Kerns, Golden, CO (US); Christopher J. King, Broomfield, CO (US); Sean Sullivan, Boulder, CO (US)

(73) Assignee: DashAmerica, Inc., Broomfield, CO (US)

( * ) Notice: Subject to any disclaimer, the term of this patent is extended or adjusted under 35 U.S.C. 154(b) by 0 days.

(21) Appl. No.: 10/631,572

(22) Filed: Jul. 30, 2003

(65) Prior Publication Data

US 2005/0022427 A1 Feb. 3, 2005

(Under 37 CFR 1.47)

(51) Int. Cl.[7] ..... A43C 11/20
(52) U.S. Cl. ..... 36/50.1; 36/54
(58) Field of Search ..... 36/50.1, 50.5, 36/54

(56) References Cited

U.S. PATENT DOCUMENTS

| | | | | | |
|---|---|---|---|---|---|
| 5,117,567 | A | * | 6/1992 | Berger | 36/50.1 |
| 5,177,882 | A | * | 1/1993 | Berger | 36/50.1 |
| 5,737,854 | A | * | 4/1998 | Sussmann | 36/50.1 |
| 5,934,599 | A | | 8/1999 | Hammerslag | |
| 6,289,558 | B1 | | 9/2001 | Hammerslag | |
| 6,477,793 | B1 | | 11/2002 | Pruitt et al. | |

* cited by examiner

*Primary Examiner*—Ted Kavanaugh
(74) *Attorney, Agent, or Firm*—Holland & Hart LLP

(57) ABSTRACT

The present invention relates to a shoe having a canopy and laterally mounted tightening apparatus. The canopy has a fixed end attached to the shoe and a free end not attached to the shoe. The free end of the canopy has lobes (or the canopy is a plurality of straps) that are moveable relatively independently of each other such that a lace attached to a tightening apparatus and the free end of the canopy tightens the shoe allowing the free ends of the canopy to facilitate the canopy molding the foot of the user.

42 Claims, 5 Drawing Sheets

SHOE TIGHTENING SYSTEM

FIELD OF THE INVENTION

The present invention relates to shoes and, more particularly, to a sport shoe tightening system.

BACKGROUND OF THE INVENTION

There exist many mechanisms for tightening shoes, boots, skates, and other footwear. Conventional mechanisms for tightening footwear range from simple manual lace tightening to more complex buckles or clamps and the like. Manual lace tightening has many drawbacks including, for example, difficulty in adjusting the lace tightness and uneven distribution of pressure from the tightening. Buckle and clamp style systems, while quicker than manual lace tightening, cause pressure points where the buckles or clamps exist. These pressure points cause localized hot spots and irritation, which can lead to blisters and the like.

VELCRO® straps can be used in place of buckles and/or laces, but they suffer many of the drawbacks of buckles in they produce localized pressure points and uneven tightness distribution. Further, the straps are prearranged, similar to buckles, inhibiting the shoe from free forming to a user's foot shape. The result is localized pressure points and hotspots that can irritate the foot.

An existing automatic lace tightening system is described by U.S. Pat. No. 6,289,558, issued Sep. 18, 2001, and U.S. Pat. No. 5,934,599, issued Aug. 10, 1999, both titled FOOTWEAR LACING SYSTEM, both issued to Hammerslag. The Hammerslag Patents describe a circular tightening apparatus that is rotated to tighten the laces and locked in place with a ratchet and pawl lock. The laces are loosened by releasing the lock by lifting the pawl and pulling on the laces to loosen them, or using reverse rotation of the ratchet. As can be seen, the Hammerslag Patents disclose a conventional shoe having an upper with an open throat. Opposing sides of the upper are tightened using the laces and tightening system of the Hammerslag Patents.

The recent trend with Cycling shoes has been to provide a shoe 100 as shown in FIG. 1. Shoe 100 has a conventional sole 102 and a conventional upper 104. Upper 104 comprises a toe box 106, a tongue 108 covering a throat opening (not specifically shown), and a heel 110. As can be seen on shoe 100, a seam 112 attaches the tongue 108 to upper 104 about toe box 106. A canopy 114 with one or more fasteners 116 are coupled to upper 104 on a first side 118 and releasably attached to upper 114 on a second side 120 such that fasteners 116 traverse tongue 108. Conventionally, fasteners 116 comprise hook and loop style fasteners, such as, for example, VELRCO® straps. These straps, however, have fixed fastening locations that cause localized pressure points, hotspots, and irritation to the user's foot.

While it would be desirous to incorporate the lacing system disclosed by the Hammerslag Patents into conventional cycling shoes, it has been discovered that incorporating the Hammerslag Patents as disclosed into cycling shoes causes localized hotspots, pressure points, and buckling in canopy 114. Thus, it would be desirous to develop an improved shoe tightening system.

SUMMARY OF THE INVENTION

To attain the advantages and in accordance with the present invention, a tightening system for a shoe is provided. The shoe comprises a sole and an upper. The upper is formed of at least a toe box, a throat, and a heel. The tightening system comprises a canopy having a fixed end and a free end. A slit in the free end extends internal to a body of the canopy forming a number of lobes. A lace runs from a tightening apparatus to the lobes allowing the canopy to be tightened on the foot of a user.

The present invention further provides a shoe with a tightening system. The shoe comprises a sole and an upper coupled to the sole. The upper comprises a toe box, a throat, and a heel. Traversing the throat is a throat cover. Traversing the throat cover is a canopy that is fixed to the upper on a fixed end and is not fixed to the upper on a free end. A lace is attached to a tightening apparatus and the free end of the canopy such that using the tightening apparatus to tighten the laces causes the canopy to tighten the shoe on the foot of a user.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

The present invention will be described with reference to FIGS. 2–4. While the present invention is shown and described with regard to a cycling shoe, one of ordinary skill in the art would recognize on reading the disclosure that alternative shoes styles could use the invention described herein, and the use of a cycling shoe is exemplary and non-limiting.

Figure 1:
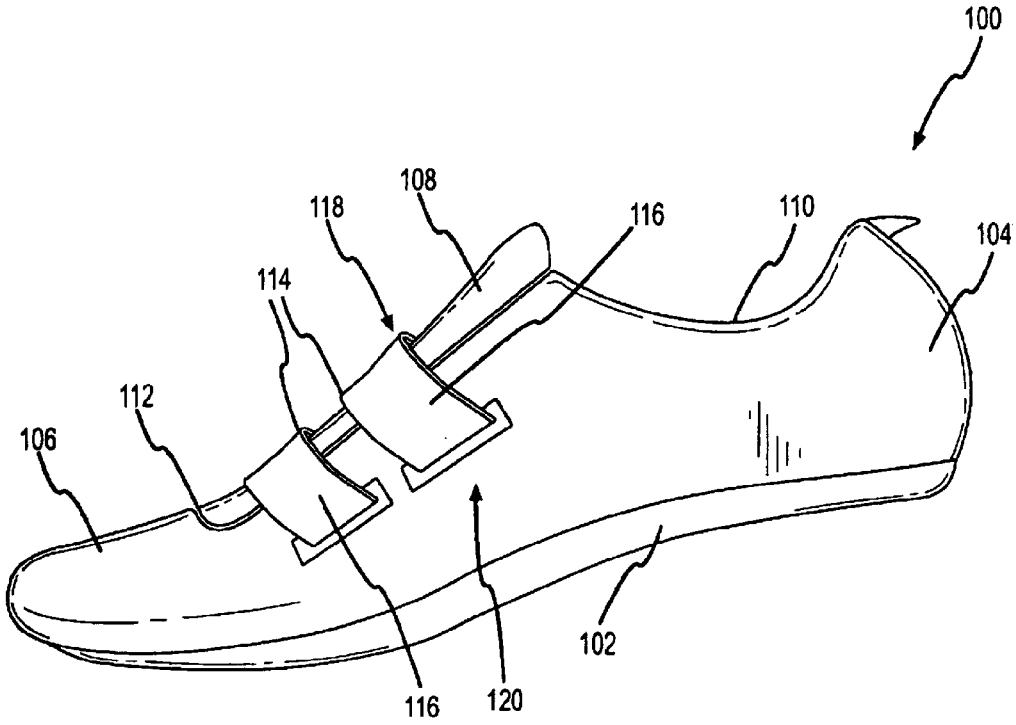
FIG.1 (Prior Art)
FIG. 1 is an elevation view of a conventional cycling shoe.
Figure 2:
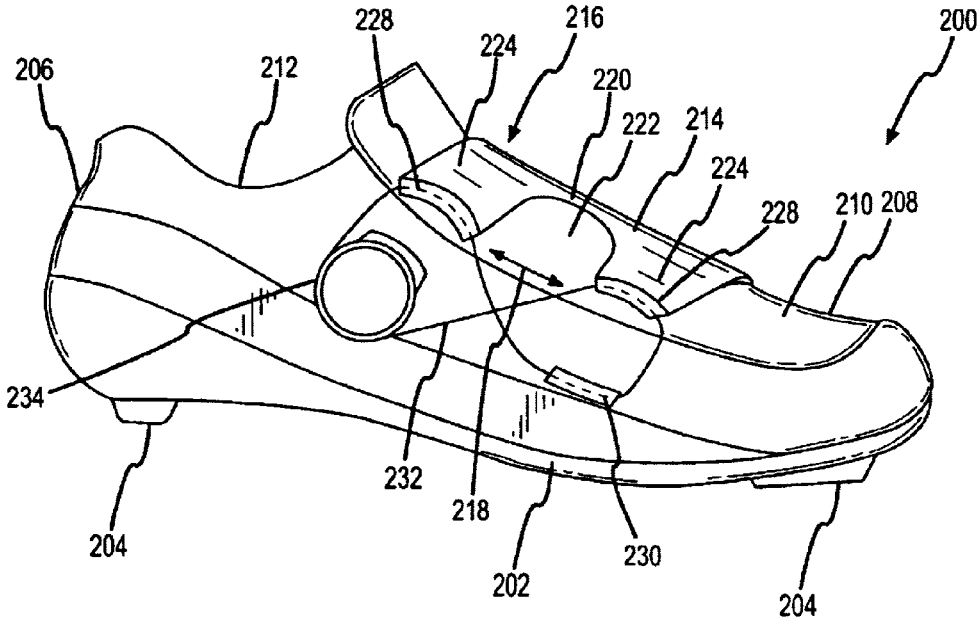
FIG. 2 is side elevation views of a shoe constructed in accordance with the present invention.
Figure 3:
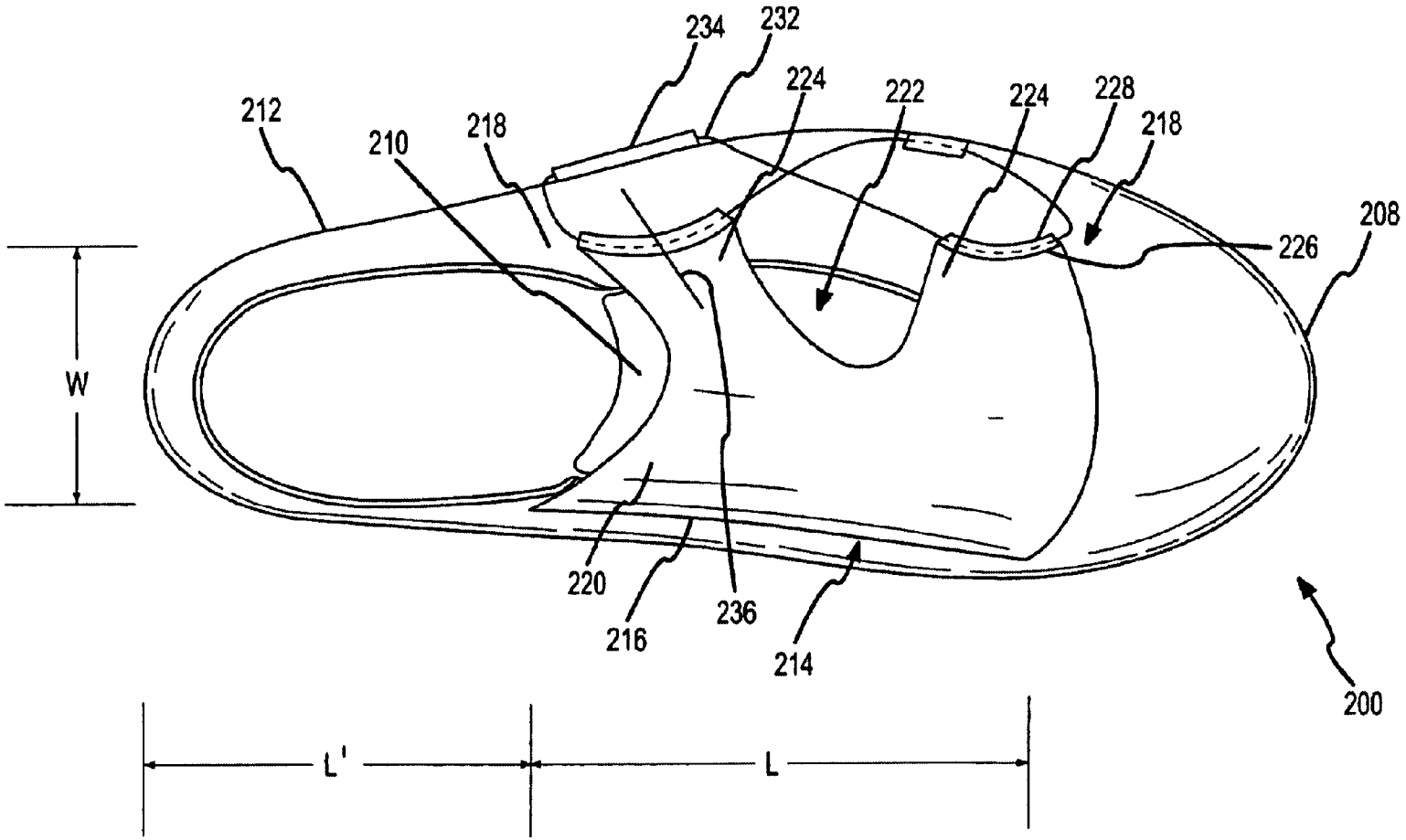
FIG. 3 is a top plan view of the shoe of FIG. 2.

FIG. 2 shows an elevation view of a cycling shoe 200. Cycling shoe 200 includes a sole 202 with lugs 204 attached to sole 202 and an upper 206 attached to the sole. Lugs 204 are optional. Upper 206 comprises a toe box 208, a throat covering 210 covering the throat opening, a heel 212, and a canopy 214 (which partially obscures throat cover 210). Throat cover 210 could be replaced with a tongue and opening similar to conventional shoes, but the bunching of the tongue and upper may cause irritation. Further, throat cover 210 optionally could be removed and canopy 214 could be stitched directly to upper 206, but it is believed this would introduce additional bunching, localized pressure points, hotspots, and irritation to the user's foot.

Canopy 214 has a fixed side 216, which is not specifically shown, on the instep of shoe 200, and a free side 218 opposite fixed side 216. A body 220 of canopy 214 traverses tongue 208 between fixed side 216 and free side 218, which is best seen in FIG. 3. Shoe 200 and canopy 214 are shown in FIG. 3 with a top plan view for ease of reference. Canopy 214 has fixed side 216 and free side 218 with body 220 extending there between. As shown, body 220 has a slit 222 or gap extending from free side 218 to an interior portion of body 220 to form at least two lobes 224 in body 220. Lobes 224 can move relatively independently of each other. An edge 226 on each lobe 224 contains a canopy cable guide 228. Optionally, canopy cable guide 228 can reside on lobes 224 proximate edge 226 instead of on edge 226. Generally, canopy cable guide 228 comprises a lumen or channel and is made of a low friction plastic, cloth, or the like. As shown, fixed side 216 resides on an instep side of shoe 200, but fixed side 216 and free side 218 could be reversed as desired.

Referring back to FIG. 2, at least one additional upper cable guide 230 is attached to shoe 200. Upper cable guide 230 comprises a lumen or channel and is made of a low friction material as well. Upper cable guide 230 is generally attached on upper 206. As can be seen, lace 232 (which is shown in phantom inside cable guides 228 and 230) runs from tightening apparatus 234 through canopy cable guides 228 and upper cable guides 230 in a zigzag pattern. Generally, there will exist one more canopy cable guide 228 than upper cable guide 230. Moreover, canopy cable guides 228 generally align with tightening apparatus 234 and upper cable guide 230. The specifics of tightening apparatus 234 are further described in U.S. Pat. Nos. 6,289,558 and 5,934,599, incorporated herein by reference.

Lobes 224 move somewhat independently to each other and are not releasably attached in a fixed location, unlike either a buckle or VELCRO strap. In other words, lobes 224 (and portions of canopy 214) move and form to a user's foot unlike a buckle or VELCRO strap that is fixed to a predetermined location irrespective of the individual user's foot. The independent movement allows canopy 214 to form to a user's foot by giving canopy 214 an additional degree of freedom. By forming to the user's foot, pressure is more evenly distributed reducing localized hotspots and irritation.

The Hammerslag Patents disclose mounting tightening apparatus 234 specifically on a tongue or behind a heel of a shoe. Largely, this placement is sufficient for the device disclosed in the Hammerslag Patents because the tightening apparatus is designed to work with a symmetrical shoe having an upper with two symmetrical closure flaps that are being secured about a throat opening and tongue. But shoe 200 is asymmetrical and does not have a tongue, but rather throat cover 210 and canopy 214. Although shoe 200 could have tightening apparatus 234 attached at the heel or tongue area, it has been found that placing tightening apparatus about the shoe arch support area on a side opposite the instep facilitates operation of the device. Thus, it is believed placing tightening apparatus 234 substantially aligned with an axis 236 of lobes 224 facilitates operation of the device. Further, to move tightening apparatus 234 to a different location, which would inhibit operation of the device, would likely require additional material, such as, for example, an additional upper cable guide to correct route the lace.

Figure 4A:
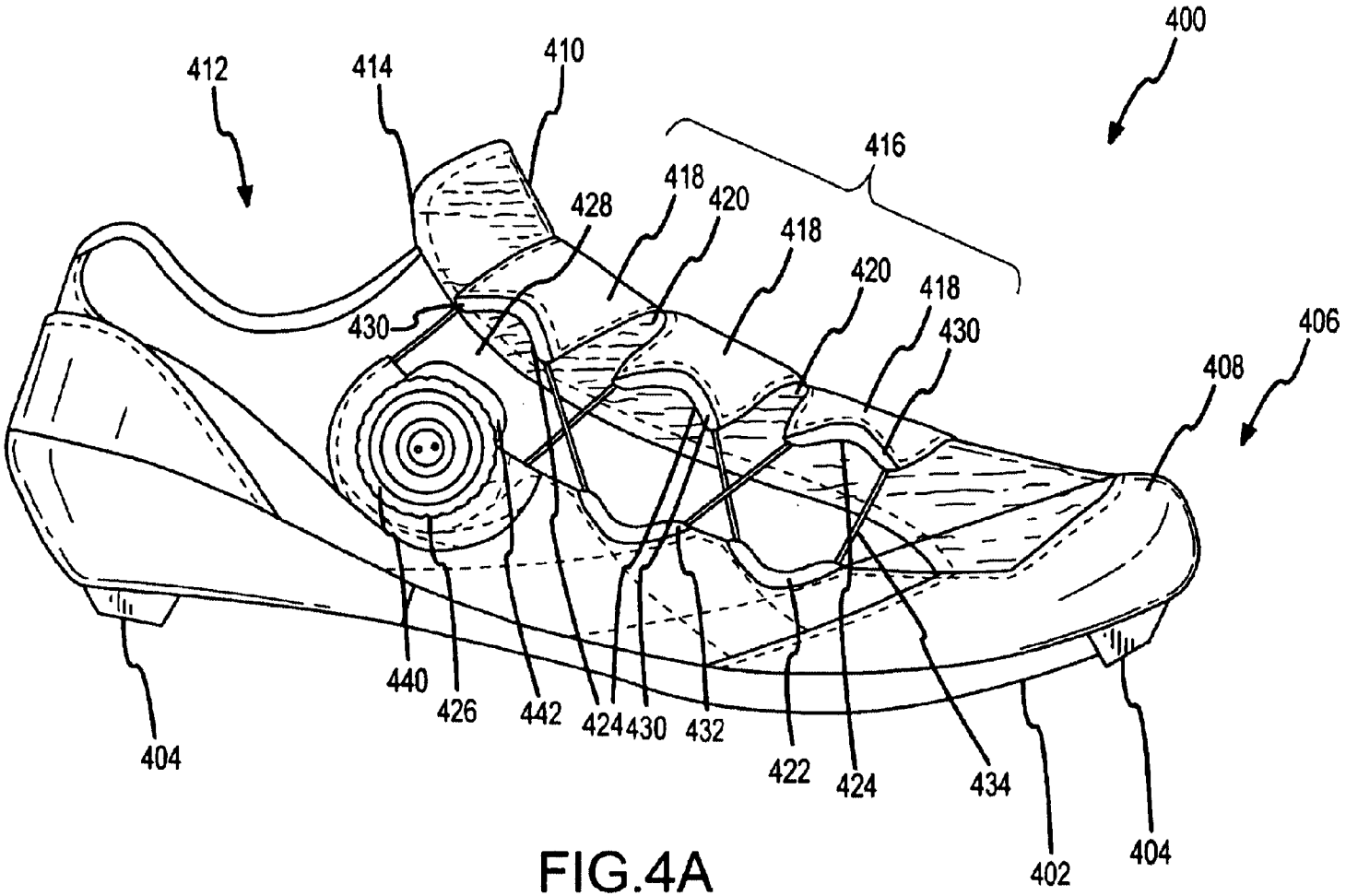
FIGS. 4A and 4B are elevation views of opposing sides of another shoe constructed in accordance with the present invention.
Figure 4B:
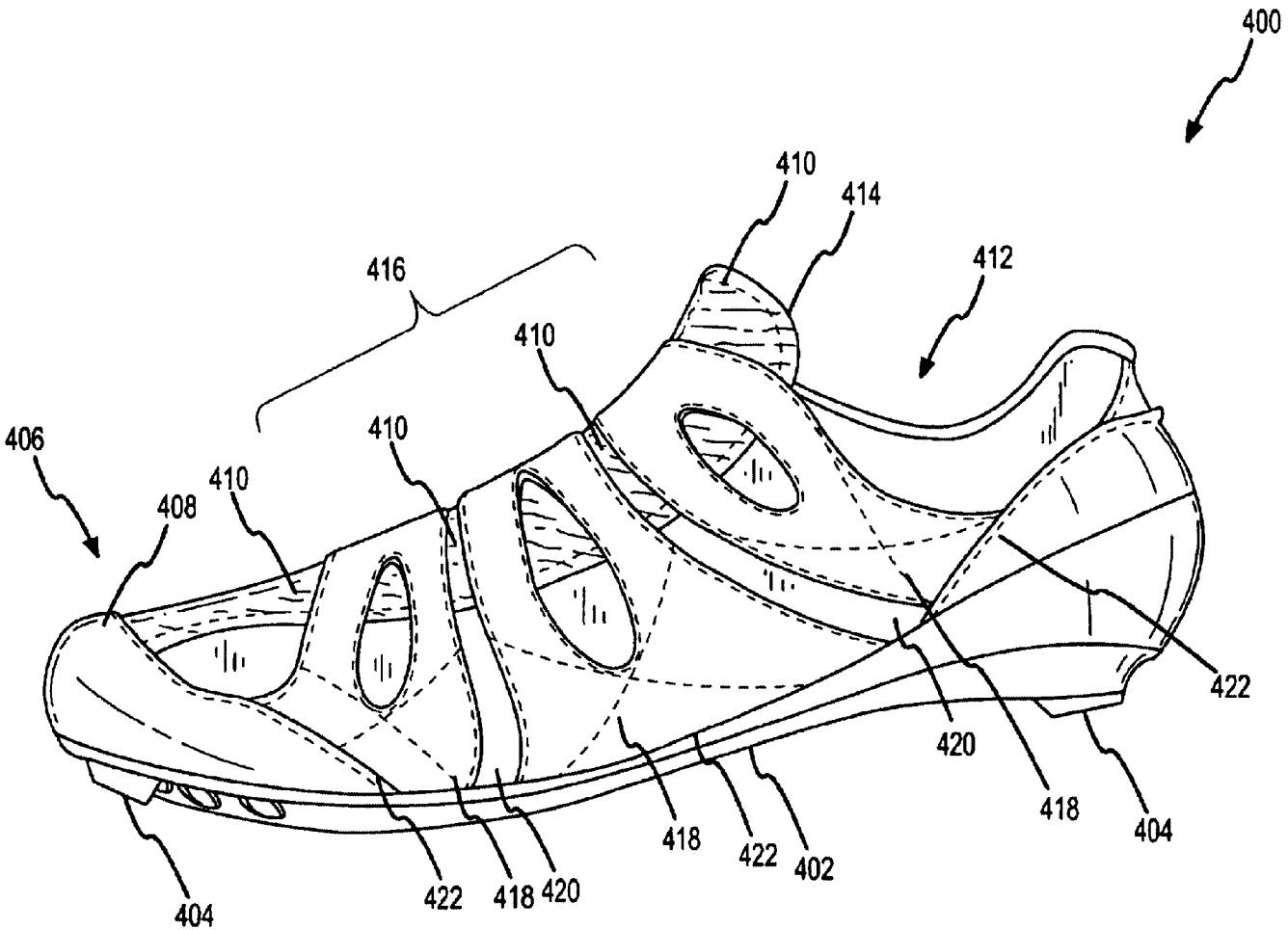

Referring now to FIGS. 4A and 4B, another shoe 400 is shown. Shoe 400 includes a sole 402 with, optionally, one or more lugs 404 and an upper 406. Upper 406 comprises a toe box 408, a throat cover 410, and a heel 412. Throat cover 410 could be replaced with a throat opening with or without a tongue. Throat cover 410 is attached to upper 406 along seam 414. In this case, a canopy 416 traversing throat cover 410 comprises a plurality of independent straps 418 separated by a plurality of gaps 420. Each strap has a fixed end 422 attached to one side of upper 406 and a free end 424. Free ends 424 are proximate tightening apparatus 426, which is generally located opposite the instep and substantially in line with an axis 428 of one of the plurality of free ends 424. Each free end 424 has a canopy cable guide 430. As one of skill in the art will recognize, aligning tightening apparatus 426 with axis 428 is a general placement suggestion and not a requirement of placement. Also existing proximate tightening apparatus 426 are upper cable guides 432. Lace 434 is shown laced between tightening apparatus 426, canopy cable guides 430 and upper cable guides 432. As can be seen in FIG. 4A, tightening apparatus 426 includes a rotating ratchet and pawl 440 and a release 442. Ratchet and pawl 440 operates such that it normally tightens lace 434 by rotating in a singular direction. Release 442 can be, for example, a lever that lifts the pawl of ratchet and pawl 440 to allow rotation in the opposite direction or simply releases the locking effect so that lace 434 can be loosened.

Shoe 400 is slightly more form fitting than shoe 200 because straps 418 move completely independent of each other, while for shoe 200 only lobes 224, and a portion of canopy 214, move somewhat independently of each other.

Lace 232 and lace 434 should be formed of a low friction material as disclosed by the Hammerslag Patents. But it is believed a low friction material alone is not sufficient for ideal operation of the tightening system. In particular, the design of the tightening system is such that replacement of the lace would be difficult. To minimize replacement, it is believed a low friction, high tensile strength lace should be used, such as, for example, a lace made out of SPECTRA® as produced by Honeywell. The SPECTRA material is actually a form of plastic known as Ultra High Molecular Weight Polyethylene. Ultra High Molecular Weight Polyethylene also is abrasion resistant.

Shoe 200 contains throat cover 210 and shoe 400 contains throat cover 410 that replaces a throat opening and tongue. It is believed using the throat cover in place of a throat opening and tongue in the upper will reduce localized pressure points, hotspots, and irritation. To aid in this reduction, covers 210 and 410 are made out of a stretchable material, such as neoprene or a stretchable mesh fabric. Of course, other textiles, synthetic fabrics, or composites could be used. For increased comfort, a more breathable open foam construction may be used and or wicking material or absorbent material may be added to the cover as is generally known in the art. Having a stretchable material facilitates with the shoe fitting the user's foot without buckling or pressure points, etc. Assisting in the slipper fit described above. To fit most cyclist, throat cover should have a length L of about 95 mm to about 155 mm, but preferably has a length L of about 125 mm. Length L, however, can range anywhere from about 40 mm to 185 mm to accommodate various ages, sexes, and foot sizes. Similarly, throat cover should have a width W of about 50 mm to about 120 mm, but preferably has a width W of about 70 mm (as measured at the top opening). Width W, however, can range anywhere from about 30 mm to about 200 mm to accommodate various ages, sexes, and foot sizes. Length L and width W will also vary depending on the stretch ability of the material. Finally, shoe 200 and shoe 400 has the top opening with a length L', which is conventional, and ranges from 60 mm to 90 mm, with 70 mm to 80 mm being the most common sizes, but preferably the length L' is about 70 mm.

While the invention has been particularly shown and described with reference to an embodiment thereof, it will be understood by those skilled in the art that various other changes in the form and details may be made without departing from the spirit and scope of the invention.

We claim:

1. A shoe comprising a sole coupled to an upper where the upper comprises a toe box, a throat opening, and a heel, the shoe containing a tightening system, the tightening system comprising:

a canopy;

the canopy comprising:

a fixed end coupled to the upper, a free end opposite the fixed end, a body between the fixed end and the free end, the body traverses the throat opening, at least one slit originating at the free end and extending into the body, the at least one slit forming a plurality of lobes in the canopy, and each of the plurality of lobes having at least one canopy cable guide attached proximate the free end thereof, a tightening apparatus connected to the upper;

at least one upper cable guide attached to the upper; and a lace;

the lace connected to the tightening apparatus, the at least one upper cable guide and each of the at least one canopy cable guides whereby using the tightening apparatus to tighten the lace facilitates the canopy molding to a foot of the user.

2. The tightening system according to claim 1, wherein the tightening apparatus comprises:

a ratchet and pawl where rotation in one direction tightens the lace; and a release to allow the lace to be loosened.

3. The tightening system according to claim 2, wherein the release allows the ratchet and pawl to rotate in the other direction.

4. The tightening system according to claim 1, wherein the lace makes a zigzag pattern between the tightening apparatus, each of the at least one canopy cable guides and the at least one upper cable guide.

5. The tightening system according to claim 1, wherein the tightening apparatus is located on a lateral side of the upper.

6. The tightening system according to claim 1, wherein the tightening apparatus is located on the lateral side of the upper opposite the instep.

7. The tightening system according to claim 6, wherein the tightening apparatus is substantially aligned with an axis of one of the free ends of the plurality of lobes.

8. The tightening system according to claim 1, further comprising:

a throat covering attached to the upper to cover the throat opening;

a seam coupling the throat cover to the upper; and the body traverses the throat covering.

9. The tightening system according to claim 8, wherein the throat covering comprises a stretchable fabric.

10. The tightening system according to claim 9, wherein the stretchable fabric comprises at least one from the group of natural fiber textiles, synthetic fiber textiles, and composite textiles.

11. The tightening system according to claim 9, wherein the stretchable fabric comprises at least one of a mesh or a neoprene.

12. The tightening system according to claim 8, wherein the throat cover comprises a length of about 40 mm to about 185 mm and a width of about 30 mm to about 200 mm.

13. The tightening system according to claim 12, wherein the throat cover comprises a length of about 125 mm and a width of about 70 mm.

14. The tightening system according to claim 12, wherein the throat tapers in a direction from the heel to the toe box.

15. The tightening system according to claim 1, wherein the at least one slit extends to the fixed side such that the canopy comprises a plurality of straps.

16. The tightening apparatus according to claim 1, wherein the plurality of canopy cable guides are attached at the free end thereof.

17. A shoe including a tightening system, the shoe comprising:

a sole;

an upper coupled to the sole;

the upper comprising a toe box, a throat, and a heel;

a throat cover attached to the upper such that the throat cover resides in the throat;

a canopy;

the canopy having at least one fixed end, a plurality of free ends, and at least one body traversing the throat cover;

at least one gap between adjacent free ends such that the body forms at least one lobe for each of the plurality of free ends of the canopy;

at least one canopy cable guide attached to each of the plurality of free ends;

at least one upper cable guide attached to the upper;

a tightening apparatus; and a lace attached to the tightening apparatus, each of the at least one canopy cable guide, and each of the at least one upper cable guide, whereby using the tightening apparatus causes the lace to tighten the canopy over the throat such that the plurality of lobes form to a foot of a user relatively independently of each other.

18. The shoe according to claim 17, wherein the shoe comprises at least one of the group consisting of a cycling shoe, a running shoe, a tennis shoe, a sneaker, a soccer shoe, a bowling shoe, a football shoe, a cleat, and a basketball shoe.

19. The shoe according to claim 17, wherein the throat cover comprises a length of about 50 mm to about 180 mm and a width of about 30 mm to about 200 mm.

20. The shoe according to claim 19, wherein the throat cover comprises a length of about 125 mm and a width of about 70 mm.

21. The shoe according to claim 17, wherein the throat cover comprises a stretchable fabric.

22. The shoe according to claim 21, wherein the stretchable fabric comprises at least one of a natural fabric, a synthetic fabric, and a composite fabric.

23. The shoe according to claim 22, wherein the stretchable fabric is neoprene.

24. The shoe according to claim 22, wherein the stretchable fabric is a mesh fabric.

25. The shoe according to claim 17, wherein the tightening apparatus is attached to the upper on a lateral side.

26. The shoe according to claim 25, wherein the tightening apparatus is attached to the lateral side opposite an instep.

27. The shoe according to claim 17, wherein each of the canopy cable guides and each of the at least one upper cable guides comprises at least a lumen and a channel.

28. The shoe according to claim 17, wherein the tightening apparatus comprises a ratchet capable of rotation, whereby rotating the ratchet causes the lace to tighten.

29. The shoe according to claim 28, wherein the tightening comprises a release that has an engaged position and a disengaged position, whereby when in the engaged position, the ratchet can rotate only in the tightening direction and in the disengaged position the ratchet can rotate in the non-tightening direction to allow the lace to be loosened.

30. The shoe according to claim 17, wherein by the at least one gap extends from the plurality of free ends to the at least one fixed end traversing the entire body of the throat covering.

31. The shoe according to claim 30, wherein the body is formed from a plurality of straps capable of moving independently of each other.

32. A shoe including a tightening system, the shoe comprising:

a sole;

an upper coupled to the sole;

the upper comprising a toe box, a throat, and a heel;

a canopy having a fixed end coupled to the upper and a body that traverses the throat;

a plurality of canopy cable guides attached to the canopy;

at least one upper cable guide coupled to the upper;

a lace; and means for tightening the lace such that the canopy tightens the upper on a foot of a user.

33. The shoe according to claim 32, wherein the means for tightening comprises:

at least one gap in the canopy forming a plurality of lobes such that portions of the canopy move relatively independently of each other; and a ratchet coupled to the upper such that the lace is coupled to the ratchet, the plurality of canopy cable guides, and the at least one upper cable guide, the ratchet rotatable in at least one direction to tighten the lace.

34. A shoe including a tightening system, the shoe comprising:

a sole;

an upper coupled to the sole;

the upper comprising a toe box, a throat, and a heel;

a throat cover attached to the upper such that the throat cover resides in the throat;

a plurality of straps;

each of the plurality of straps having a fixed end coupled to one side of the shoe and a free end on the opposite side of the shoe;

at least one canopy cable guide attached proximate to each of the free ends;

at least one upper cable guide attached to the upper;

a tightening apparatus; and a lace attached to the tightening apparatus, each of the at least one canopy cable guide, and each of the at least one upper cable guide, whereby using the tightening apparatus causes the lace to tighten the canopy over the throat such that the plurality of straps tighten around the foot of a user relatively independently of each other.

35. The shoe according to claim 34, wherein the shoe comprises at least one of the group consisting of a cycling shoe, a running shoe, a tennis shoe, a sneaker, a soccer shoe, a bowling shoe, a football shoe, a cleat, and a basketball shoe.

36. The shoe according to claim 34, wherein the throat cover comprises a length of about 50 mm to about 180 mm and a width of about 30 mm to about 200 mm.

37. The shoe according to claim 34, wherein the throat cover comprises a stretchable fabric.

38. The shoe according to claim 34, wherein the tightening apparatus is attached to the upper on a lateral side.

39. The shoe according to claim 38, wherein the tightening apparatus is attached to the lateral side opposite an instep.

40. The shoe according to claim 34, wherein the tightening apparatus comprises a ratchet capable of rotation, whereby rotating the ratchet causes the lace to tighten.

41. The shoe according to claim 40, wherein the tightening comprises a release that has an engaged position and a disengaged position, whereby when in the engaged position, the ratchet can rotate only in the tightening direction and in the disengaged position the ratchet can rotate in the non-tightening direction to allow the lace to be loosened.

42. The shoe according to claim 34, wherein the throat cover is attached to the upper by a stitched seam.

* * * * *